US010160008B1

(12) United States Patent
Liu et al.

(10) Patent No.: US 10,160,008 B1
(45) Date of Patent: Dec. 25, 2018

(54) ALUMINUM ALLOY HUB POLISHING COLOR REGISTER PROCESS

(71) Applicant: CITIC Dicastal CO.,LTD, Hebei (CN)

(72) Inventors: Guohua Liu, Hebei (CN); Guangcai Chen, Hebei (CN); Le Wang, Hebei (CN); Qun Zhao, Hebei (CN); Chong Li, Hebei (CN); Lei Bao, Hebei (CN)

(73) Assignee: CITIC DICASTAL CO., LTD (CN)

( * ) Notice: Subject to any disclaimer, the term of this patent is extended or adjusted under 35 U.S.C. 154(b) by 0 days.

(21) Appl. No.: 15/673,895

(22) Filed: Aug. 10, 2017

(30) Foreign Application Priority Data

Jun. 22, 2017 (CN) ..... 2017 1 0482438

(51) Int. Cl.

| | |
|---|---|
| ***B05D 1/04*** | (2006.01) |
| ***B05D 3/00*** | (2006.01) |
| ***B05D 3/02*** | (2006.01) |
| ***B05B 5/03*** | (2006.01) |
| ***B05D 7/14*** | (2006.01) |

(52) U.S. Cl.
CPC ..... *B05D 1/04* (2013.01); *B05B 5/03* (2013.01); *B05D 3/002* (2013.01); *B05D 3/0254* (2013.01); *B05D 7/14* (2013.01)

(58) Field of Classification Search
CPC .. B05B 5/03; B05D 1/04; B05D 3/002; B05D 3/0254
See application file for complete search history.

(56) References Cited

FOREIGN PATENT DOCUMENTS

CN 103394454 A * 11/2013

* cited by examiner

*Primary Examiner* — Xiao S Zhao
(74) *Attorney, Agent, or Firm* — Zheng Liu; Weintraub Tobin

(57) ABSTRACT

This patent discloses an aluminum alloy hub polishing color register process, specifically comprising the following steps of: polishing a blank, pre-treating, spraying transparent powder 1, curing, placing a hard protector, spraying a colored paint, curing, polishing a color register boundary line off line, pre-treating, spraying transparent powder 2, curing and discharging. The process solves the problems that the polished surface is easily scratched in the color register boundary treatment process and that the treatment efficiency is relatively low in the traditional polished color register products, improves the yield and production efficiency of polished color register products and increases the additional values of the products.

1 Claim, No Drawings

ALUMINUM ALLOY HUB POLISHING COLOR REGISTER PROCESS

RELATED APPLICATION

This application claims priority to Chinese Patent Application No. 201710482438.1, filed on Jun. 22, 2017, which is hereby incorporated by reference in its entirety.

TECHNICAL FIELD

The present invention relates to an aluminum alloy hub coating process, specifically to an aluminum alloy hub polishing color register process.

BACKGROUND OF THE INVENTION

Polished color register products are very important ones among aluminum alloy hub color register products, and are widely popular with consumers due to good contrast effect of polished areas and colored paint surfaces. At present, the color register process for the products universally adopts hard protection and air spraying, and has the problems that the fuzzy color register boundary is unlikely to treat, the polished surface is easily scratched and the efficiency is low when the boundary is manually wiped, etc., thereby seriously restricting the production of the polished color register products.

SUMMARY OF THE INVENTION

An aluminum alloy hub polishing color register process specifically comprises the following steps of: polishing a blank, pre-treating, spraying transparent powder 1, curing, placing a hard protector, spraying a colored paint, curing, polishing a color register boundary line off line, pre-treating, spraying transparent powder 2, curing and discharging.

The process parameters for spraying transparent powder 1 require: adopting electrostatic spraying for the transparent powder, powder throughput/air throughput: 50-70%, air throughput: 4.0-6.0 $m^3$/h, and electrostatic voltage: 60-80 kv; and the curing condition of the transparent powder 1 comprises: keeping the temperature of workpiece at 180° C. for 15 min. The thickness of the transparent powder 1 is 70-130μm.

Placing a hard protector comprises: placing a red copper follow color register protector on a hub before spraying, and exposing the part where the colored paint needs to be sprayed.

The process parameters for spraying the colored paint require: using air guns for spraying, wherein the operation parameters comprise: operation viscosity of the colored paint: 16-17" (Din-4), paint throughput: 60-120 CC, atomization pressure: 1.5-2.5 bar, sector pressure: 2.0-3.5 bar, and gun distance: 180-250 mm. The curing condition of the colored paint comprises: keeping the temperature of the workpiece at 150° C. for 10-15 min.

Polishing a color register boundary line off line means manual polishing treatment, and comprises the steps of scraping redundant paint mist at the color register boundary line with a wallpaper scraper and then lightly polishing scratches with 1000#.

The process parameters for spraying transparent powder 2 require: adopting electrostatic spraying for the transparent powder, powder throughput/air throughput: 50-70%, air throughput: 4.0-6.0 $m^3$/h, and electrostatic voltage: 60-80 kv; and the curing condition of the transparent powder 2 comprises: keeping the temperature of workpiece at 180° C. for 15 min.

In the present invention, transparent powder is sprayed onto the polished matrix before polishing color register, then hard protection color register is performed, the color register boundary is manually polished off line, and a layer of acrylic transparent powder is sprayed. The acrylic transparent powder has good leveling property, and the polishing marks on the bottom acrylic transparent powder can be well covered by the outermost acrylic transparent powder, so that the problems of scratches and polishing marks easily occurring when the metal matrix is polished in the prior art are solved, and the yield and the production efficiency are greatly improved.

Compared with the traditional color register process, this process not only ensures the consistency of the color register boundary, but also solves the problem of scratches of the polished surface and remarkably improves the yield of the product.

DETAILED DESCRIPTION OF THE EMBODIMENTS

Embodiment 1: The process parameters for spraying transparent powder 1 require: adopting electrostatic spraying for the transparent powder, powder throughput/air throughput: 65%, air throughput: 5.0 $m^3$/h, and electrostatic voltage: 60 kv. The curing condition of the transparent powder 1 comprises: workpiece temperature 180° C., kept for 15 min.

The process parameters for spraying a colored paint require: using air guns for spraying, wherein the operation parameters comprise: operation viscosity: 16-17" (Din-4), paint throughput: 100 CC, atomization pressure: 2.0 bar, sector pressure: 2.5 bar, and gun distance: 200 mm. The curing condition of the colored paint comprises: keeping the temperature of the workpiece at 150° C. for 13 min.

The process parameters for spraying transparent powder 2 require: adopting electrostatic spraying for the transparent powder, powder throughput/air throughput: 60%, air throughput: 4.5 $m^3$/h, and electrostatic voltage: 60 kv. The curing condition of the transparent powder 2 comprises: keeping the temperature of the workpiece at 180° C. for 15 min.

Embodiment 2: The process parameters for spraying transparent powder 1 require: adopting electrostatic spraying for the transparent powder, powder throughput/air throughput: 60%, air throughput: 5.0 $m^3$/h, and electrostatic voltage: 60 kv. The curing condition of the transparent powder 1 comprises: keeping the temperature of the workpiece at 180° C. for 15 min.

The process parameters for spraying a colored paint require: using air guns for spraying, wherein the operation parameters comprise: operation viscosity: 16-17" (Din-4), paint throughput: 90 CC, atomization pressure: 2.0 bar, sector pressure: 2.0 bar, and gun distance: 200 mm. The curing condition of the colored paint comprises: keeping the temperature of the workpiece at 150° C. for 14 min.

The process parameters for spraying transparent powder 2 require: adopting electrostatic spraying for the transparent powder, powder throughput/air throughput: 60%, air throughput: 4.0 $m^3$/h, and electrostatic voltage: 60 kv. The curing condition of the transparent powder 2 comprises: keeping the temperature of the workpiece at 180° C. for 15 min.

Embodiment 3: The process parameters for spraying transparent powder 1 require: adopting electrostatic spraying for the transparent powder, powder throughput/air throughput: 70%, air throughput: 5.0 $m^3$/h, and electrostatic voltage: 60 kv. The curing condition of the transparent powder 1 comprises: keeping the temperature of the workpiece at 180° C. for 15 min.

The process parameters for spraying a colored paint require: using air guns for spraying, wherein the operation parameters comprise: operation viscosity: 16-17" (Din-4), paint throughput: 120 CC, atomization pressure: 2.5 bar, sector pressure: 3.0 bar, and gun distance: 200 mm. The curing condition of the colored paint comprises: keeping the temperature of the workpiece at 150° C. for 14 min.

The process parameters for spraying transparent powder 2 require: adopting electrostatic spraying for the transparent powder, powder throughput/air throughput: 60%, air throughput: 5.0 $m^3$/h, and electrostatic voltage: 60 kv. The curing condition of the transparent powder 2 comprises: keeping the temperature of the workpiece at 180° C. for 15 min.

The invention claimed is:

1. An aluminum alloy hub polishing color register process, comprising:

polishing a blank of an aluminum alloy hub, pre-treating the aluminum alloy hub for a first time, spraying transparent powder 1 onto the blank, curing the transparent powder 1, placing a hard protector on a portion, but not all, of the aluminum alloy hub, using one or more air guns to spray a colored paint onto the aluminum alloy hub, curing the colored paint, polishing a color register boundary line off line, pre-treating the aluminum alloy hub for a second time, spraying the transparent powder 2 onto the colored paint, curing the transparent powder 2 and discharging an excess portion of the transparent powder 2, wherein spraying the transparent powder 1 onto the blank is done under following conditions: adopting electrostatic spraying for the transparent powder 1, powder throughput/air throughput: 50-70%, air throughput: 4.0-6.0 $m^3$/h, and electrostatic voltage: 60-80 kv;

curing the transparent powder 1 is done under following conditions: keeping temperature of the aluminum alloy hub at 180° C. for 15 min; and thickness of the transparent powder 1 is between 70 μm and 130 μm;

spraying the colored paint onto the aluminum alloy hub is done under following conditions: operation viscosity of the colored paint: 16-17 centistokes as measured by a Din-4 cup, paint throughput: 60-120 CC, atomization pressure: 1.5-2.5 bar, sector pressure: 2.0-3.5 bar, and gun distance: 180-250 mm;

curing the colored paint is done under following conditions: keeping temperature of the aluminum alloy hub at 150° C. for 10-15 min;

spraying the transparent powder 2 onto the colored paint is done under following conditions: adopting electrostatic spraying for the transparent powder 2, powder throughput/air throughput: 50-70%, air throughput: 4.0-6.0 $m^3$/h, and electrostatic voltage: 60-80 kv; and curing the transparent powder 2 is done under following conditions: keeping temperature of the aluminum alloy hub at 180° C. for 15 min.

* * * * *